United States Patent [19]

Bugamelli

[11] Patent Number: 5,012,780

[45] Date of Patent: May 7, 1991

[54] STAND ALONE FUEL INJECTION SYSTEM

[75] Inventor: Ralph Bugamelli, Sterling Heights, Mich.

[73] Assignee: Coltec Industries Inc., New York, N.Y.

[21] Appl. No.: 475,464

[22] Filed: Jan. 5, 1990

[51] Int. Cl.[5] ..... F02D 41/08; F02M 51/00

[52] U.S. Cl. ..... 123/339; 123/478; 123/488

[58] Field of Search ..... 123/339, 445, 472, 478, 123/480, 488, 494, 497, 511, 514

[56] References Cited

U.S. PATENT DOCUMENTS

| | | | |
|---|---|---|---|
| 4,096,831 | 6/1978 | Gunda | 123/488 |
| 4,212,277 | 7/1980 | Melotti | 123/472 X |
| 4,341,193 | 7/1982 | Bowler | 123/472 |
| 4,347,823 | 9/1982 | Kessler et al. | 123/472 |
| 4,372,271 | 2/1983 | Elpern et al. | 123/472 X |
| 4,705,001 | 11/1987 | Danno et al. | 123/339 |
| 4,827,897 | 5/1989 | Yamada et al. | 123/497 |

*Primary Examiner*—Willis R. Wolfe
*Attorney, Agent, or Firm*—Howard S. Reiter

[57] ABSTRACT

An electronic fuel injection system operable as a bolt on retro fit replacement for a wide variety of carburetors is disclosed. The system includes a throttle body-injector assembly which, by means of an adapter may be bolted directly to stock intake manifolds using the carburetor mounting bolt holes in the manifold. The throttle body passages and injectors are designed to meet the fuel and air delivery requirements of large displacement engines and an electronic control unit which controls the solenoid actuated injectors in a duty cycle operation is provided with externally accessible adjustments by means of which the system may be adjusted to tune the rate of fuel injection to the fuel delivery requirements of engines of displacements much smaller than the largest displacement engine within the systems capability. The system may be independently adjusted for optimum or user selected economy or power operation at idle, mid range and high rpm engine operation and further includes choke and accelerating enrichment adjustments. The control unit also controls operation of the fuel pump to maintain a constant injection pressure at all times.

18 Claims, 5 Drawing Sheets

STAND ALONE FUEL INJECTION SYSTEM

BACKGROUND OF THE INVENTION

The present invention relates to an electronically controlled fuel injection system package for automotive vehicles which may be employed as a retro fit replacement for carburetors used on engines having widely different displacements.

Over the past several years, the automotive industry has shifted to the use of electronically controlled fuel injection systems to the point where practically all new passenger cars manufactured in the United States today are equipped with electronic fuel injection systems. However, there are many older vehicles still on the road equipped with conventional carburetors, and a certain number of new vehicles manufactured in foreign countries continue to employ carburetors as original equipment. The phasing out of carburetors as original equipment by the automotive industry in the United States and by many foreign automobile manufacturers presents a major economic problem both to original equipment carburetor manufacturers and suppliers and to owners of carburetor equipped vehicles. The substantially reduced and still declining market for carburetors makes it uneconomical for the manufacturer to maintain high volume production lines and the consequent price increases must be passed on to the purchaser. The problem is aggravated because of the fact that carburetors typically are designed for a specific model of engine and thus there is a wide variety of existing models of carburetors which are not interchangeable with each other. Automotive part supply houses can no longer afford to maintain complete replacement carburetor inventories.

The present invention is directed to a so-called stand alone (self contained) fuel injection system designed to constitute a retro fit replacement for a wide variety of carburetors which includes an electronic control unit provided with externally accessible adjustments which enables the system to be tuned for usage with automotive engines whose displacement may differ over a wide range.

SUMMARY OF THE INVENTION

A stand alone fuel injection system embodying the present invention preferably includes two solenoid actuated fuel injectors supplied by a fuel pump, and an electronic control unit adapted to receive inputs representative of the throttle position, engine temperature and engine RPM and to suply a pulse-width modulated output signal which controls energization of the injector solenoids. The capacity of the injectors and pump are selected so that the system is capable of supplying adequate fuel to an engine of relatively large displacement, and the electronic control unit is provided with externally accessible potentiometer adjustments so that fuel delivery can be regulated to be matched to the reqirements of engines of substantially smaller displacements. Adjustments are provided for tuning the control unit at idle, mid range and high RPM operation of the engine, for response to rapid acceleration, and for cold start operation. The system may thus be tuned by a relatively simple procedure to the specific engine upon which it is mounted so that the system is capable of providing efficient fuel delivery to engines of widely different displacement.

For engines equipped with a four barrel intake manifold, the injector may be bolted directly in place by the use of an adapter plate which matches the injector housing bolt holes and the standard bolt hole configuration on the four barrel manifold. For tose engines not equipped with a four barrel manifold, commercially available so called universal aftermarket manifolds may be employed.

The fuel pump is designed to provide an over supply of fuel to the injectors and a return line to the fuel tank returns the excess fuel while maintaining a constant fuel pressure at the injector inlets. The injectors are of a conventional type in which a valve is opened upon energization of its actuating solenoid under the control of a pulse width modulated signal from the electronic control unit.

Other objects and features of the invention will become apparent by reference to the following specification and to the drawings.

IN THE DRAWINGS

Figure 1:
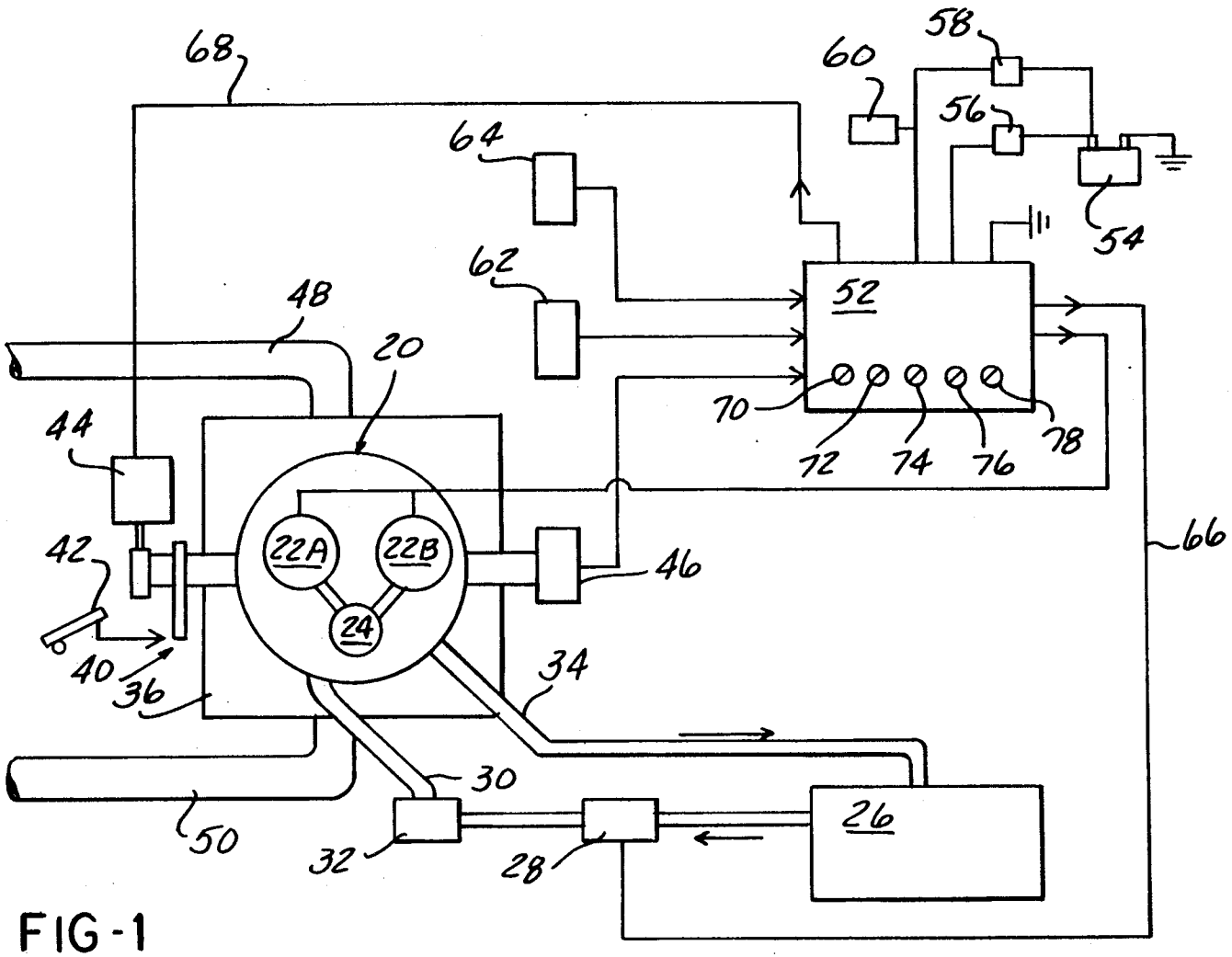
FIG. 1 is a schematic diagram of a fuel injection system embodying the present invention.

In FIG. 1, the major components of a fuel injection system embodying the present invention and their general interrelationship to each other is schematically shown. The system includes a throttle body injector assembly designated generally 20 having a pair of solenoid actuated fuel injectors 22A, 22B and a fuel pressure regulator 24. Fuel is supplied to injectors 22A, 22B from the vehicle fuel tank 26 by an electric fuel pump 28 which pumps fuel from the tank into regulator 24 via an inlet conduit 30 which conventionally will include a fuel filter 32. During normal operation of the system, pump 20 is operated to supply more fuel to the injectors 22A, 22B than is discharged by the injectors, and pressure regulator 24 functions to return the excess fuel to the fuel tank via return conduit 34 while maintaining a constant fuel pressure at the injectors. Each injectors 22A, 22B cyclically discharges pulses of fuel into combustion air passages (not shown in FIG. 1, see FIG. 2) to establish the desired fuel/air mixture which passes from throttle body 20 through an adapter plate 36 into the intake manifold (not shown) of the vehicle engine (not shown).

Figure 2:
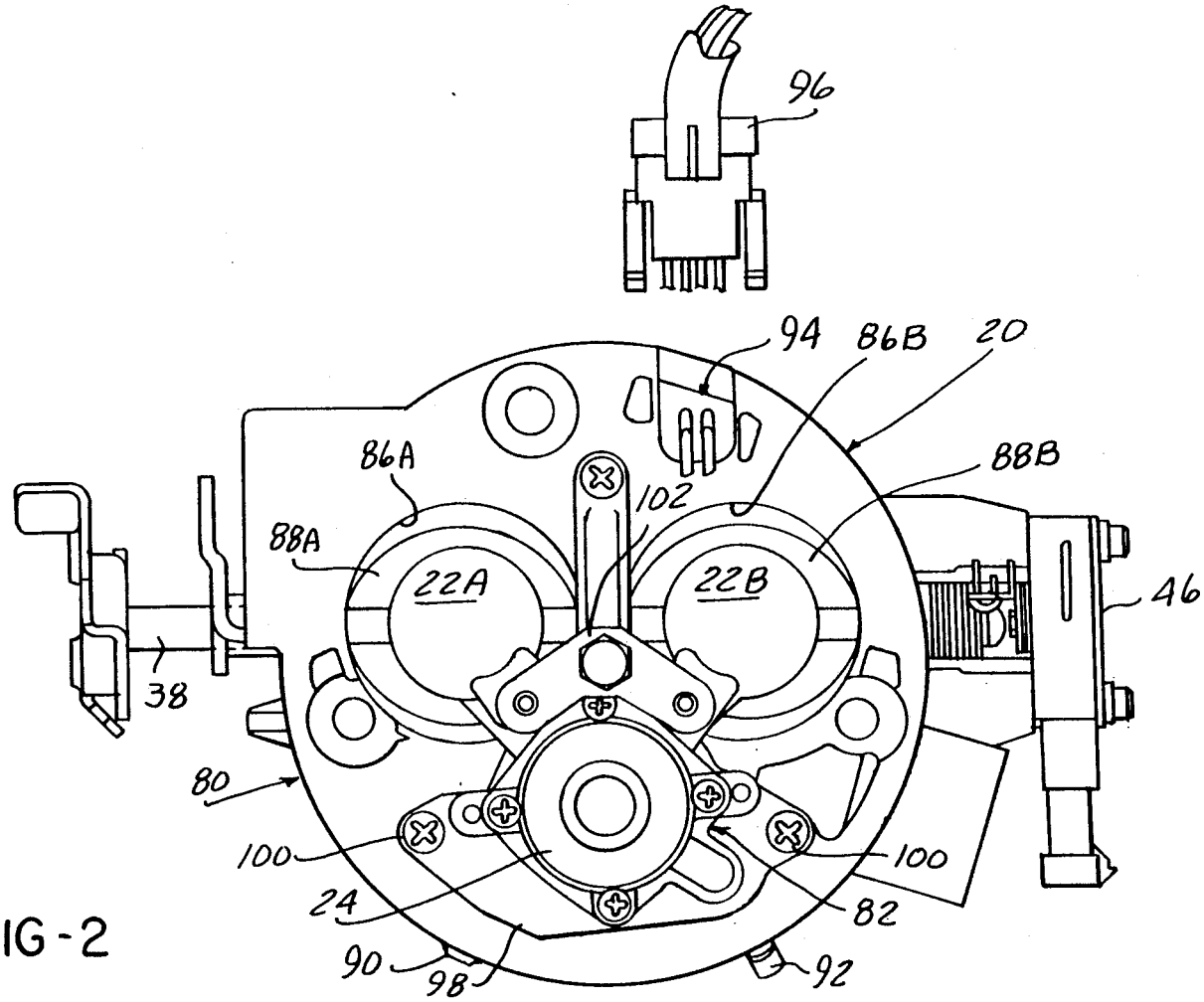
FIG. 2 is a top plan view of the throttle body-injector assembly of the system of FIG. 1.

Throttle plates of conventional construction (not shown) in FIG. 1, see FIG. 2) are mounted within the air passages of the throttle body 20 upon a throttle shaft 38 ibn a well known manner, the throttle shaft 38 being coupled by mechanical linkage designated generally 40 to the accelerator pedal 42 of the vehicle in a well known conventional manner. Throttle shaft 38 is also mechanically coupled to the armature of a fast idle solenoid 44 and to a throttle position sensor 46.

Adapter plate 36 functions to mechanically mount throttle body 20 upon the intake manifold of the vehicle engine. Adapter 36 is formed with an internal chamber (FIG. 5), through which engine coolant is circulated via hoses 48 and 50 connected to the engine cooling system (not shown) to heat the plate to prevent icing.

In the particular system here disclosed, it is desired that the system be capable of use with engines whose displacement may be any where within the range of approximately 240 cubic inches to 454 cubic inches. To supply adequate combustion air to engines having a displacement at the high end of this range, it is necessary that the intake manifold of the engine be a four barrel manifold, and adapter plate 36 is provided with bolt holes located to enable the plate to be bolted directly to the various stock four barrel manifolds or to the equivalent after market universal manifold. To satisfy the fuel requirements of the larger displacement engines, each of injectors 22A, 22B has the capability of flowing up to 80 pounds of fuel per hour and the two barrel throttle body 20 is designed to flow up to 670 cubic feet of air per minute at 1.5 inches manifold vacuum. These capabilities enable the system to equal the performance of most high performance four barrel carburetors.

Operation of injectors 22A, 22B is controlled by an electronic control unit 52 which is energized by the vehicle battery 54 via an ignition key operated switch 56 to supply power to the control unit when the key is in an on position and the vehicle starter is not cranking. A separate power connection between battery 54 and control unit 52 is provided via the starter switch 58 to supply power to certain portions of the circuit of unit 52 which function only while the engine starter 60 is cranking.

As will be described in greater detail below, control unit 52 functions to generate a pulse width modulated signal which cyclically energizes and deenergizes the actuating solenoids of injectors 22A, 22B. Control unit 52 varies the pulse width and frequency in response to variations in engine operating conditions monitored by the system. In the specific system disclosed, control unit 52 receives an input signal representative of the throttle position from throttle position sensor 46. An input signal representative of engine RPM is received by control unit 52 from an engine tachometer trigger source 62, and a third input signal is received by the control unit from an engine coolant temperature sensor 64. The input signals from throttle position sensor 46, tachometer trigger 62 and temperature sensor 64 are processed within control unit 52, in manner to be described in greater detail below, the compute and generate the pulse width modulated signals transmitted to the actuating solenoids of injectors 22A, 22B. The control unit 52 also provides output signals to control operation of the electric fuel pump 28 via cable 66 and the fast idle solenoid 44 via cable 68.

Adaptation of the system to match the fuel requirements of different engines whose displacement may differ over a range of 200 cubic inches or more is accomplished by providing the electronic control unit 52 with externally accessible adjustments which, in a manner to be described in greater detail below, vary or modify the output of certain portions of the signal processing circuitry of control unit 52. In the system here disclosed, five such adjustments are provided and are identified in FIG. 1 as a choke adjustment 70, an accelerator pump adjustment 72, an idle adjustment 74, a mid range adjustment 76, and a power adjustment 78. Essentially, each of these adjustments applies an adjustment factor within the control unit circuitry to adjust the pulse width and frequency of the actuating signal transmitted to the injector solenoid to accordingly lean or enrich the fuel mixture during a particular engine operating mode.

The choke adjustment 70 functions to adjust operation of the fast idle solenoid for cold start and engine warm up and this adjustment determines when the fast idle solenoid will be deactivated.

The accelerator pump adjustment adjusts the rate at which the fuel mixture is enriched when the accelerator pedal is depressed to accelerate the engine.

The idle adjustment 74 regulates the warm engine idle speed, while the mid range and power adjustments 76, 78 are employed to established the fuel air mixture ratio at mid range and high speed operation of the engine.

Collectively, the adjustments enable the system to be matched to the fuel delivery requirements of a wide variety of engines, and further provide the capability of tuning a given engine for either high performance of fuel efficient operation in accordance with the vehicle owners preference.

THROTTLE BODY INJECTOR ASSEMBLY

Figure 3:
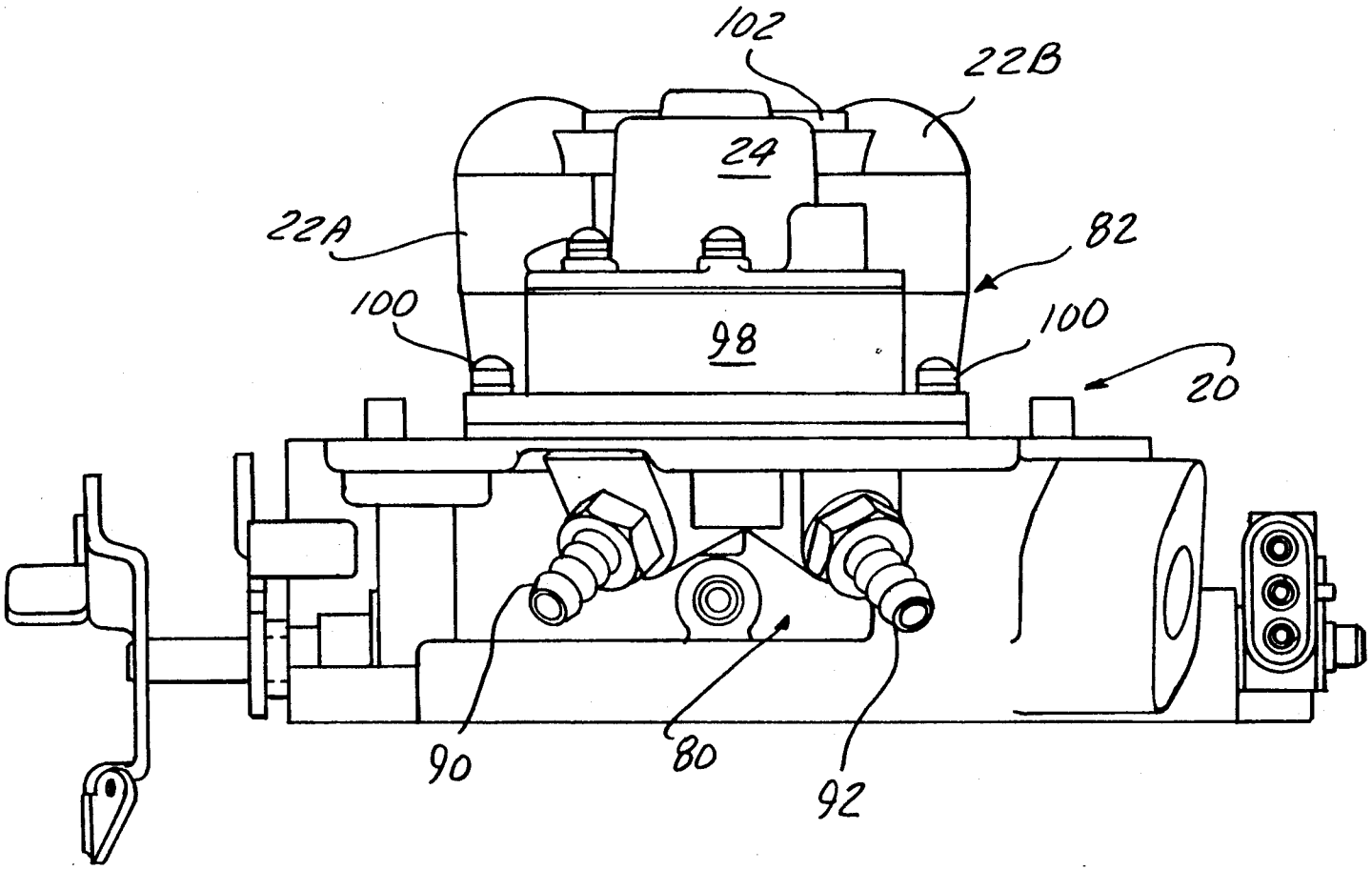
FIG. 3 is a side elevation view of the assembly of FIG. 2.
Figure 4:
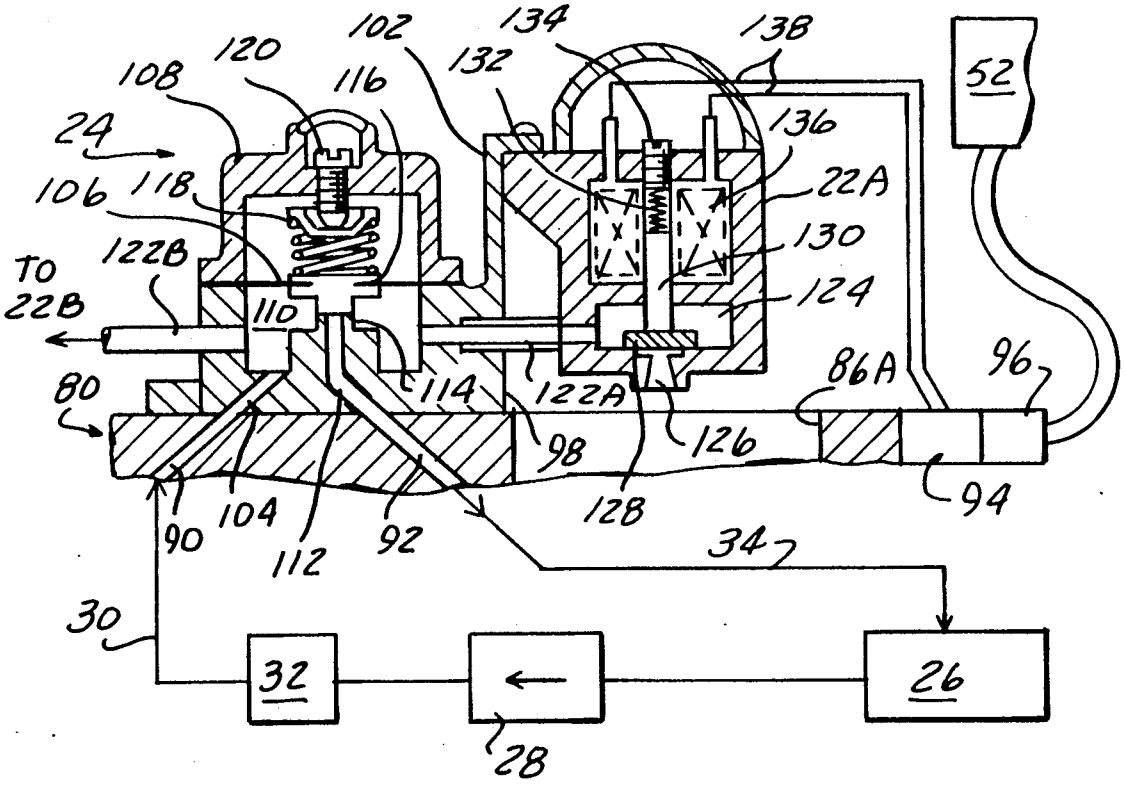
FIG. 4 is a schematic cross sectional view of a portion of the assembly of FIG. 2.

The throttle body injector assembly 20 is best seen in FIGS. 2–4, and is made up of two major subassemblies, namely a two barrel throttle body sub assembly designated generally 80 and an injector sub assembly designated generally 82 which includes injectors 22A, 22B and pressure regulator 24. Suitable gaskets, not shown, will be employed between the two subassemblies and adapter plate 36.

Throttle body assembly 80 is formed with a pair of combustion air passages 86A, 86B which pass vertically entirely through assembly 80 (FIG. 2). Throttle plates 88A, 88B are fixedly mounted in a well known manner on throttle shaft 38 to throttle the flow of the fuel-air mixture through passages 86A, 86B in accordance with the rotary position of shaft 38 in a well known manner.

Throttle body 80 also includes, best seen in FIG. 3, fuel inlet 90 and fuel outlet 92 fittings which are respectively connectible to the fuel inlet conduit 30 and outlet conduit 34 (FIG. 1). Electrical wiring (not shown) from the solenoid coils of injectors 22A, 22B and throttle position sensor 46 is led to terminals 94 on body 80 adapted to be connected via a connector 96 (FIG. 2) to electronic control unit 52.

The lower housing portion 98 of pressure regulator 24 of the injector sub assembly 82 is fixedly mounted as by bolts 100 (FIGS. 2 and 3) upon the top throttle body 80. Injectors 22A and 22B are supported as by brackets 102 fixedly secured to housing 98 and the throttle body 80 with the injectors 22A, 22B supported immediately above and in coaxial alignment with the respective throttle body passages 86A, 86B.

A conventional air cleaner, not shown, will be mounted upon the top of throttle body 80 to enclose the injector sub assembly 82 within its clean air chamber.

The precise construction of pressure regulator 24 and injectors 22A and 22B may take any of several well known forms. Regulators 24 functions to maintain a continuous supply of fuel at constant pressure for the injectors. The injectors 22A, 22B essentially are solenoid actuated on-off valves which are normally closed and shifted to a fully opened position in response to energization of the associated solenoid. When the valve is opened, fuel under pressure maintained by regulator 24 is discharged from the injector into combustion air flowing downwardly through associated throttle body passage 86A, 86B. A detailed description of one form of a solenoid actuated injector operable in response to a pulse width modulated control signal is disclosed in U. S. Pat. No. 4,708,117 to which reference may be had for further details of injectors suitable for use in the present application.

The functional interrelationship of the pressure regulator, injectors and throttle body may be best understood by reference to the schematic diagram of FIG. 4. In FIG. 4, the fuel inlet fitting 90 on throttle body 80 is schematically indicated as an inlet passage 90 through throttle body 80 which communicates with an inlet passage 104 formed in the lower housing 98 of pressure regulator 24 when the housing is assembled to throttle body 80. A flexible diaphragm 106 is fixedly clamped by a housing cover 108 to lower housing 98 to define a flexible upper wall of an internal chamber 110 within lower housing 98. Fuel outlet fitting 92 is schematically shown in FIG. 4 as an outlet passage 92 which communicates with an outlet passage 112 through housing 98 when housing 98 is assembled upon throttle body 80. The upper end of outlet passage 112 opens through a valve seat 114 into chamber 110. A valve head 116 carried by diaphragm 106 is resiliently biassed against valve seat 114 by a compression spring 118 to block fluid communication between chamber 110 and outlet passage 112 when head 116 is seated upon seat 114. An adjustment screw 120 threadably received within upper housing member 108 is employed to adjust the compressive force of spring 118, and thus adjust the pressure within chamber 110 at which the head 116 opens.

Outlet passages 122A, 122B lead from chamber 110 to the respective injectors 22A, 22B. The injectors are of identical construction, hence only injector 22A has been shown in FIG. 4.

Passage 122A from chamber 110 opens into a chamber 124 in injector 22A having an outlet passage or nozzle 126 opening at the bottom of the injector. The upper end of passage 126 is normally closed by a valve head 128 carried on the lower end of a solenoid armature 130 which is spring biassed downwardly as by a compression spring 132 whose compressive force may be adjusted by an adjustment screw 134. Armature 130 is slidably received within the central passage of a solenoid coil 136 whose windings are electrically connected via leads 138, terminal 94 and connector 96 to the electronic control unit 52. Upon energization of solenoid coil 136, armature 130 is magnetically biassed upwardly to lift valve head 128 clear of passage 126 to permit fuel in chamber 124 to be discharged in an atomized spray from nozzle 126 into the upper end of throttle body passage 86A. Although valve head 128 is shown as having a flat head, other head configurations, such as a ball or conical head may be employed.

The electronic control unit 52 functions to supply solenoid coil 136 with intermittent energizing pulses whose frequency and time duration are controlled, in a manner to be described in greater detail below, by the control unit in accordance with various engine operating conditions monitored by the control unit. This type of control is frequently referred to as a duty cycle operation and under this operation, the valve constituted by head 128 and passage 126 is either fully closed (when the solenoid is not energized) or fully open (when the solenoid is energized). Over a given time period, the amount of fuel discharged through the valve is directly proportional to the percentage of time over that period during which the valve is opened. A more detailed description of a duty cycle operation of this type may be found in U. S. Pat. No. 4,708,117 referred to above.

As previously stated, fuel pump 28 is intentionally operated under the control of control unit 52 at a speed such that more fuel is supplied to pressure chamber 110 of pressure regulator 24 than is discharged by the injectors. Pump 28 pumps fuel from fuel tank 26 through filter 32 and conduit 30 into fuel inlet 90 and through passage 104 into chamber 110 of the regulator. Since more fuel is coming in to chamber 110 than is being discharged from the injectors the pressure in chamber 110 (and chamber 124) will increase until the pressure within chamber 110 is sufficient to flex diaphragm 106 upwardly against the action of spring 118 to lift valve head 116 of seat 114 to enable fuel to flow from the chamber 110 through outlet passage 112, 92 and into return line 34 to return to fuel tank 26. The pressure in chamber 110 (and chamber 124) is thus maintained at a pressure determined by the compressive force of spring 118 as adjusted by screw 120, and the direct fluid communication between chamber 110 and the inlet chamber 124 of the injector causes the pressure in the injector chamber 124 to be maintained at the same pressure that exists in the chamber 110. Excess pressure is relieved by venting fuel from chamber 110 via outlet passage 112 when the pressure in chamber 110 exceeds that required to unseat valve head 116 from its seat 114. Outlet passage 112 and return line 34 are made large enough to accommodate substantially unrestricted flow from chamber 110 to tank 26 when valve head 116 is unseated.

Figure 5:
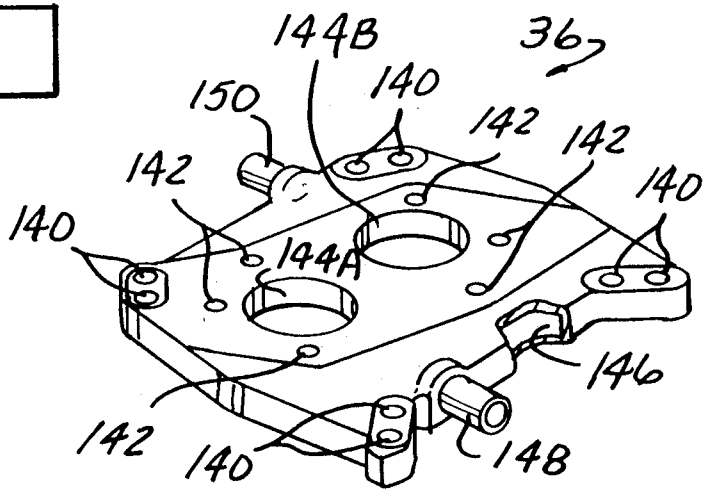
FIG. 5 is a perspective view, with certain parts broken away, of an adapter plate of the system of FIG. 1.

Adapter plate 36 is illustrated in FIG. 5. Plate 36 is formed with four pairs of bolt holes 140 so located as to enable the adapter plate to be directly bolted unto all General Motors, Chrysler and universal after market four barrel manifolds. An additional adapter plate, not shown, will be required to mount the adapter plate 36 on Ford manifolds. The plate 36 is provided with tapped bores as at 142 to accommodate bolting of throttle body 80 onto the upper surface of the adapter plate. A pair of through passages 144A and 144B are formed in a plate 36 to define continuations of throttle body passages 86A, 86B when the throttle body is mounted upon plate 36. As best seen from the broken away section of plate 36, the plate is hollow to define an internal chamber 146 through which engine coolant may be circulated via an inlet fitting 148 and outlet fitting 150 to heat plate 36 to prevent icing of the throttle plates.

ELECTRONIC CONTROL UNIT

The objective of an electronically controlled fuel injection system for an automotive engine is to provide the optimum fuel to air mixture ratio in the face of variations in selected engine operating conditions. The amount or rate of flow of combustion air of the mixture is basically determined by the engine displacement, a fixed dimension, and engine speed which is variable. The electronic control unit is programmed to compute rate at which fuel must be injected to achieve and maintain the optimum fuel to air mixture ratio in response to variations in monitored engine operating conditions.

Electronic control units for this purpose have been available for quite some time, and the design of appropriate circuitry for converting the monitored inputs to the appropriate output signal is well understood. Control unit 52 will thus be described in terms of the functional block diagram of FIG. 6.

The electronic control unit 52 responds to inputs from the various sensors 46, 62 and 64 and the setting of variable potentiometers (adjustments 70, 72, 74, 76 and 78) and provides an output in the form of a pulse width modulated signal to fuel injectors 22A and 22B of the engine to control the frequency of activation and the duration of the fuel injectors to inject fuel into the throttle body. The electronic control unit 52 also generates outputs to control fuel pump 28 and the fast idle solenoid 44.

The electronic control unit includes a means for generating a pulse width modulated (PWM) signal to the injectors 22 which comprises duration circuits labeled 152A and 152B for injector 22A and injector 22B, respectively. The duration circuits, shown in FIG. 6, ramp voltages driven at the oscillator frequency. The output signal from the oscillator 154 causes current flow in a capacitor in each of the duration circuits 152A and 152B thus changing the voltage across the capacitor. This voltage is linearized through transistors. This process is repeated after every clock pulse of the oscillator 154 to create the ramp voltage at the input of a comparator in each duration circuit 152A and 152B once for each clock pulse. The ramp voltages are compared to a pulse width or duration voltage from another portion of the circuitry by the comparator in each duration circuit 152A and 152B which outputs a square wave signal having a pulse width proportional to the pulse width or duration voltage. The pulse width modulated signal is sent to the injector drivers 154A and 154B which comprise power transitors which energize the injector solenoids 136 open the injectors to inject fuel into the throttle body at a high solenoid activation current and then hold the injectors open with a lower holding current. A snubber circuit 156 is connected between the injector driver circuits 154A and 154B. The snubber circuit 156 protects the injector drivers 154A and 154B from the reverse EMF voltage which develops when current is removed from the injector solenoids and the magnetic field therein collapses. This EMF voltage is shunted to ground through the use of diodes and a power transistor forming the snubber circuit 156.

Power to the electronic control unit 52, the fuel injector solenoids 136, the fuel pump 28 and the cold start solenoid 44 is received through the vehicle's ignition switch 52 to provide the regulated voltages required by the various electronic circuits forming the electronic control unit 52. Upon the initial activation of the ignition switch 56, the start circuit 158, through a pump speed circuit 160, grounds the fuel pump 28 through the fuel pump driver 162 for a predetermined time, such as one second, in order to prime the fuel lines of the engine. The pump driver circuit 162 includes a MOSFET transistor, not shown, which is activated by a signal from the pump speed circuit 160. The pump speed circuit 160 provides a square wave signal to the fuel pump driver 162 which determines the fuel pump 28 speed by varying the duty cycle of the square wave signal. The duty cycle is calculated based on injector duty cycle information.

During engine cranking, a voltage is applied to the start circuit 158 through the switch 58 to signal the pump speed circuit 160 to run the fuel pump 28 at full speed. The start circuit 158 also generates a voltage signal when the start key 58 signal is activated by turning on a transistor which applies a regulated voltage to a resistor divider network. The output of the resistor divider network is sent to the input of an oscillator 154. This voltage signal determines the frequency of the signal sent to the injector duration circuits 152A and 152B to determine the frequency of fuel injection from injectors 22 into the throttle body.

The electronic control unit 52 utilizes the oscillator circuit 154 as a means for controlling the frequency of the pulse width modulated signal provided to the duration circuits 152A and 152B as described above. The oscillator 154 is a voltage controlled oscillator which receives an input signal from a RPMV generator 164. The RPMV generator 164 is connected to a signal conditioning circuit 166 which converts the high voltage spikes from a tach signal 62 connected to the vehicle engine distributor, for example, to a clean square wave of proper amplitude. The RPMV generator 164 is a frequency to voltage converter circuit which converts the square wave signals from the signal conditioning circuit 166 to a voltage. The voltage signal output from the RPMV generator 164 is applied to the input of the oscillator 154 and is proportional to the engine speed as read by the tach 62.

The oscillator circuit 154 converts the output of the RPMV generator 164 to a square wave of proper frequency which is used to control the frequency of activation of the fuel injectors 22A, 22B. During steady state operation, the output frequency from the oscillator 154 is proportional to the speed of the engine. During idle, acceleration and deceleration conditions, the input voltage to the oscillator 154 from the RPMV generator 164 and other inputs is modified, thus resulting in an altered output frequency to the solenoids of fuel injectors 22A, 22B.

Also input to the duration circuit 152A and 152B is the output of a circuit 168 for generating a signal of a predetermined pulse width which defines the duration of each frequency cycle that the injectors 22A, 22B open. Generally, the pulse width signal generating means 168 is responsive to the output of a throttle position sensor 46 and is modified by the idle adjustment 74, a mid-range adjustment 76 and a power or high RPM adjustment 78, as described thereafter.

The throttle position sensor 46 is connected to the throttle shaft 38 and indicates the amount of throttle opening and also the rate of opening of the throttle. A regulated 5v signal is sent to the throttle position sensor 46 and is divided so that the output is low at idle engine speeds and ratiometrically increases to a higher voltage as the throttle is moved from the idle to wide open position. The output of the throttle position sensor 46 is input to a throttle position circuit 170 which acts as a buffer to the remaining circuits in the electronic control unit 52.

The output from the throttle position circuit 170 is input to a throttle position to fuel voltage signal circuit 172 formed of an analog multiplier. The throttle position signal from sensor 46 is converted to a current signal which is input to the analog multiplier where it is combined with a current signal from a temperature circuit 174, described hereafter. The resultant product is input to circuit 176. Circuit 176 is formed of a current multiplier circuit which multiplies two current signals input to the multiplier circuit and divides the product by a third current signal input to the circuit fo form a composite signal which is input to the pulse width signal generating means or circuit 168. The composite signal corresponds to the air/fuel ratio for a particular set of engine operating conditions.

The voltage output of the throttle position to fuel voltage circuit 172 is sampled by a sample and hold circuit in the pulse width signal generating or duration voltage circuit 168 each time a pulse is received from the oscillator 154 prior to being input to the fuel injector duration circuit 152A and 152B. This determines the base idle pulse width for the fuel injectors and can be modified by adjusting an idle control means 74. Preferably, the idle control means 74 is an adjustable potentiometer connected to the circuit 164 to vary the base idle pulse width as described hereafter.

Minimum injector duration is controlled by a clamp circuit 178 to keep the fuel injectors 22A, 22B operating in their designed linear range even when less fuel is called for by a lean idle control setting determined by the idle potentiometer 74. The minimum duration clamp circuit 178 monitors the duration voltage sent to the duration circuits 152A and 152B. If this voltage reaches a predetermined minimum level such as by turning the idle control means 74 to a lean setting, this voltage is retained even if the idle control means 74 is turned further to a leaner position. A minimum duration circuit 180 is activated when the clamp circuit 178 is operating and is connected through a mixer 182 to an input of the oscillator 154. The minimum duration circuit 180 sends an offset voltage to the input of the oscillator 154 where it is subtracted from RPMV generator 164 voltage. Thus, as the idle control means or adjustment 74 is turned to a leaner position, the offset voltage increases thus decreasing the osciallator input voltage and decreasing the frequency of injection.

During cranking of the engine by starter 60, the output from the throttle position sensor 46 is input through the first throttle position buffer circuit 170 to the start circuit 158. A clear flood mode is provided during cranking when the throttle position, as detected by the throttle position sensor 46, is fully open. At this time, the output from the throttle position sensor 46 is 3.8v or higher which, through the start circuit 158, inhibits the oscillator 154 and the injector drivers 154A and 154B controlled thereby through the duration circuits 152A and 152B, respectively, to prevent fuel delivery through he injectors 22A, 22B. The oscillator 154 is shut off when a high voltage (logic level 1) is applied to one input of the oscillator circuit 154. This voltage is developed in the start circuit 158 where a comparator looks at the start key 58 signal and the throttle position signal from sensor 46. When the signal from throttle position sensor 46 is 3.8v or higher, the comparator output is high thus actuating the clear flood mode.

During steady state or mid-range engine operation, the output signal from the throttle position sensor 46 is at a higher voltage than at idle engine conditions. This signal, through the throttle position circuit 170 and the throttle position to fuel voltage circuit 172, offsets the voltage applied to the pulse width generating circuit 168 through the analog multiplier in the circuit 172. As the throttle position sensor 46 voltage increases, the voltage drop across a resistive network also increases, thus increasing current flow into the analog multiplier in the circuit 172. The output from the analog multiplier is input to the duration voltage circuit 168 which now sees a higher or offset voltage than the voltage seen at this point during idle conditions. This occurs since more fuel is required at part throttle engine operations due to the added air flow. An adjustment from a potentiometer 76 is provided in the circuit 176 to trim part throttle fuel requirements and provide mid-range or steady state operation control for the fuel injection system.

At higher engine load conditions requiring more throttle opening, power I and power II circuits 184 and 186, respectively, are employed. The power I circuit 184 supplies voltage signals generated by op-amps which are converted to current signals and input to the circuit 176 which modifies the generation or duration voltage circuit 168. A power adjustment 78 in the form of a potentiometer is connected to the power I circuit 184 to trim overall load fuel requirements.

The power II circuit offsets the currents generated by the power I circuit 184 at engine operating speeds under 3,000 rpm and can be shaped to provide any fuel curve depending upon engine efficiency. The power II circuit 186 is internally calibrated by changing the values of internal resistors for predetermined engine sizes.

Figure 6:
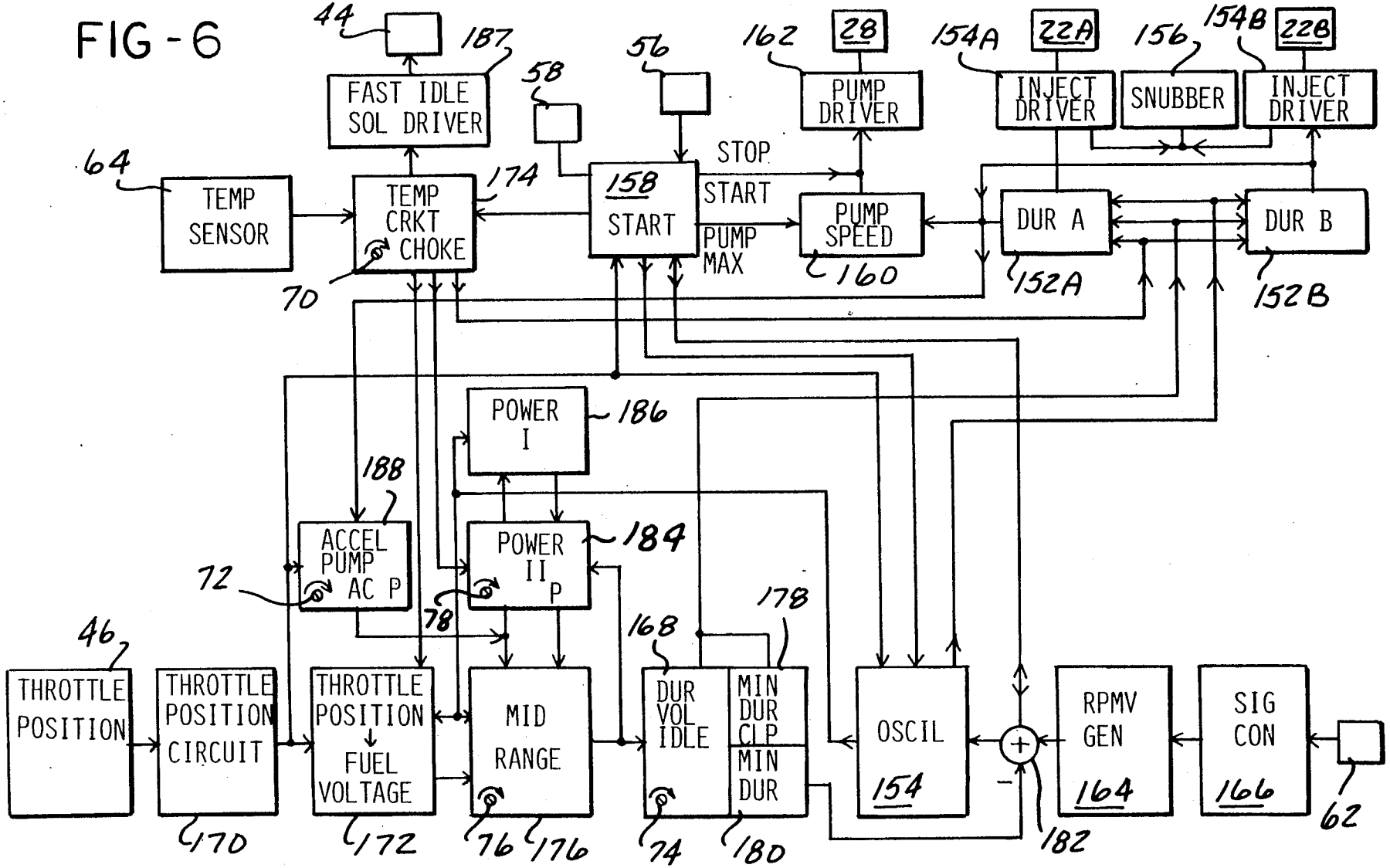
FIG. 6 is a functional block diagram of the electronic control unit of the system of FIG. 1.

The electronic control unit 52 also receives an input from temperature sensor 64 to increase fuel delivery to the injectors 22A, 22B during cold engine operation. Temperature sensor 64 senses engine coolant temperature and provides an output signal which varies in resistance inversely with engine temperature. The temperature sensor 64 is a negative coefficient thermistor that is molded into a brass housing which screws into a water passage in the intake manifold or cylinder head of the engine. The output signal from the temperature sensor 64 is input as a voltage signal to the temperature circuit 174. As shown in FIG. 6, the temperature circuit 174 outputs current signals to the throttle position to fuel voltage circuit 172, the power I circuit 184 and the injector duration circuits 152A and 152B which results in an increased injector pulse width signal proportional to any given engine temperature. A user adjustable temperature adjustment means, such as a potentiometer 70 labeled "choke", is provided to adjust the cold enrichment function of the electronic control unit 52 for various engine/vehicle combinations.

The cold enrichment function provided by the temperature circuit 174 decays at a rate controlled by the temperature sensor 64 and corresponds to the time required for the engine to reach operating temperature. As the engine coolant temperature increases, the resistance of the temperature sensor 64 decreases which signals the temperature circuit 174 to decrease fuel delivery. When the engine reaches operating temperature, (180°–200° F.) no further cold enrichment is provided by the temperature circuit 174.

Also output from the temperature circuit 174 is a signal to a fast idle solenoid driver 187 connected to the fast idle solenoid 44. The solenoid driver 187 energizes the fast idle solenoid 44 to rotate throttle shaft 38 a predetermined amount to increase idle speed during the engine warm-up period. The shut-off point of the fast idle solenoid 44 is determined by engine temperature and the choke control setting provided by the potentiometer 70. Typically, this is between an engine operating temperature of 120°--160 ° F.

Also included in the electronic control unit 52 is an accelerator pump circuit 188 which provides extra fuel enrichment during throttle opening times. The output of the accelerator pump circuit 188 provides the extra fuel enrichment by increasing the injector pulse width, as well as increasing the injection frequency.

In operation, a change in the ouput of the throttle position sensor 46 causes current to flow in a capacitor in the accelerator pump circuit 188 which is multiplied in the analog multiplier circuit 176. This raises the output voltage input to the pulse width signal generating circuit 168 for a momentary time thereby momentarily increasing the pulse width of the signal applied to the duration circuits 152A and 152B.

The output from the throttle position circuit 170 is also coupled to the oscillator 154 through another capacitor and is summed by the osciallator circuit 154 with the RPMV generator 164 voltage signal to momentarily boost the injection frequency.

The injection frequency and duration signals from the duration circuits 152A and 152B are fed back to the accelerator pump circuit 188 to vary the amount of added fuel for varying engine speeds. As engine speed increases, less accelerator pump fuel is added. The adjustment means or potentiometer 72 is provided to enable the transition fuel to be tailored for various engine and chasis combinations.

The fuel pump 28 supplying fuel to the injectors 22A, 22B is driven by a pump driver circuit 162 which is controlled in speed by the pump speed circuit 160. As the engine increases in speed and load, a voltage signal to the fuel pump 28 is increased thereby increasing the output from the fuel pump 28. The pump driver 162 acts as a switching power supply circuit driven by the pump speed circuit 160. The pump speed circuit 160 receives injector pulse width information in the form of square wave pulses from the comparators in the duration circuits 152A and 152B. These pulses are of the same duration as the injector pulse width. The duty cycle of these signals controls the duty cycle of the fuel pump 28 thus allowing the fuel pump 28 to vary in speed. Throughout all types of engine operation, the output from the fuel pump 28 increases and decreases in proportion to an increase or decrease in the fuel injector duty cycle. The pump speed circuit 160 also shuts off the fuel pump 28 whenever the output signal from the tach 62 is interrupted. Whenever the tach 62 signal is interrupted or ceases, signals from the signal conditioner circuit 166, the RPMV generator 164, the oscillator 154 and the duration circuits 152A and 152B are likewise interrupted. This eliminates an input to the pump speed circuit 160 from the duration circuits 152A and 152B thereby shutting off the fuel pump 28.

The various adjustable potentiometers 70, 72, 74, 76 and 78 are used as tuning aids to adjust the stand-alone fuel injection system of the present invention once it is installed on an engine. The adjustment procedure is as follows:

While holding the throttle steady so that it maintains approximately 3,000 rpm, the mid-range potentiometer 76 is rotated until peak rpm or engine vacuum is achieved. The mid-range potentiometer 76 is then rotated in the opposite direction until engine speed just begins to drop. This establishes the mid-range setting for the stand-alone fuel injection system of the present invention.

With the engine idling, the idle adjustment potentiometer 74 is then rotated for peak engine rpm or vacuum. The idle potentiometer 74 is then rotated in an opposite direction until engine speed just begins to drop.

With the engine idling and the vehicle in neutral or park, the accelerator pump potentiometer 72 is adjusted for a smooth, quick response when the throttle is "tipped in" or quickly moved to the full open position. The "accel pump" potentiometer 72 is adjusted for the fastest response from the engine.

Acceleration tests are required to adjust the power potentiometer 78 to the proper position. The power potentiometer 78 is adjusted for the fastest wide open throttle acceleration in a range of 1,500–4,000 rpm. The "accel pump" potentiometer 72 is also adjusted during operation of the vehicle. With the vehicle in second gear and traveling at about 20 mph, the throttle is instantly moved to the wide open throttle position.

If the engine bogs or falls flat and a puff of black smoke comes out of the exhaust pipe, the "accel pump" setting is too high and may be adjusted. If the engine bogs down and falls flat and there is no smoke from the exhaust pipe, then too little "accel pump" setting is provided and the "accel pump" potentiometer 72 must be adjusted in an opposite direction.

Cold starts are affected by the choke potentiometer 70. The choke adjustment 70 is adjusted for a clean crisp drive-away from an idle speed. If the fast idle solenoid 44 disengages too soon, corrective adjustment may be made by the choke potentiometer 72.

Control unit 52 is mounted in the passenger compartment of the vehicle so that the unit is not exposed to the heat and fumes of the engine compartment. As schematically shown in FIG. 1, the five adjustments are mounted on one face of the unit to provide convenient access. Suitable electric cables couple the control unit to the various components of the system located in the engine compartment.

SUMMARY

The system described above may be considered broadly as a fuel supply system which has the capability of supplying fuel at a rate sufficient to meet the maxiumu fuel requirements of a relatively large displacement engine. The electronic control unit, whose output signal establishes the rate at which fuel is supplied by the injectors, may be tuned to adjust the fuel injection rate to match the combustion air flow rate schedules of engines of smaller displacements at idle, mid range and high rpm operation and for cold start and acceleration enrichment. The system is designed as a bolt on replacement for carburetors employed on engines whose displacements may vary from approximately 240 cubic inches to 450 cubic inches and may be set up, by a simple adjustment procedure, to achieve optimum fuel to air mixture ratios for any engine within such a displacement range over a wide range of engine operating conditions.

While one embodiment has been described in detail, it will be apparent to those skilled in the art that the disclosed embodiment may be modified. Therefore, the art foregoing description is to be considered exemplary rather than limiting and the true scope of the invention is that defined in the following claims:

I claim:

1. A stand-alone throttle body fuel injection system including fuel injector means for injecting fuel from a throttle body into the fuel-air inlet of an engine manifold, comprising:

an electronic control means for controlling the activation of the fuel injector, the electronic control means comprising:

means for generating a pulse width modulated signal having a predetermined frequency and pulse width to the fuel injectors;

frequency signal generating means, responsive to the engine RPM, for generating a signal to the pulse width modulated signal generating means having a frequency proportional to the engine RPM;

pulse width signal generating means, responsive to the engine throttle position, for generating a signal to the pulse width modulated signal generating means having a pulse width proportional to the engine throttle position;

throttle position sensor means for sensing the throttle position and generating an output proportional thereto;

means, responsive to the engine RPM, for generating an engine RPM signal; and an accelerator pump adjustment means adjustably responsive to a full open position of the throttle plate sensor means, the accelerator pump adjustment means input to the pulse width signal generating means and the frequency signal generating means to increase the pulse width and the frequency in proportion thereto.

2. A fuel injection system for an internal combustion engine having a fuel supply tank and an intake manifold having a fuel-air mixture inlet;

said system comprising a throttle body having a combustion air passage means extending therethrough from a combustion air inlet to an outlet, adjustably positionable throttle means in said combustion air passage means for controlling the flow of a fuel-air mixture therethrough, adaptor means for mounting said throttle body on said manifold with the outlet of said combustion air passage means opening into said fuel-air mixture inlet of said manifold, cyclically operable fuel injection means on said body for cyclically injecting pulses of fuel into said combustion air passage means, fuel pump means for pumping fuel to said injection means from said fuel supply tank, control means including throttle position sensing means and engine speed sensing means for cyclically actuating said injection means to inject fuel into said passage in pulses of time durations and cyclic frequencies variable in response to variations in throttle position and engine speed respectively sensed by said throttle position and said engine speed sensing means, and manually operable adjustment means on said control means for establishing independently selected fuel to air mixture ratios during idle, mid range, and high speed operations of said engine.

3. A stand-alone throttle body fuel injection system including fuel injector means for injecting fuel from a throttle body into the fuel-air inlet of an engine manifold, comprising:

an electronic control means for controlling the activation of he fuel injector, the electronic control means comprising:

means for generating a pulse width modulated signal having a predetermined frequency and pulse width to the fuel injectors;

frequency signal generating means, responsive to the engine RPM, for generating a signal to the pulse width modulated signal generating means having a frequency proportional to the engine RPM;

pulse width signal generating means, responsive to the engine throttle position, for generating a signal to the pulse width modulated signal generating means having a pulse width proportional to the engine throttle position;

throttle position sensor means for sensing the throttle position and generating an output proportional thereto;

means, responsive to the engine RPM, for generating an engine RPM signal;

first idle adjustment means, input to the pulse width signal generating means, for establishing a base idle pulse width;

second mid-range adjustment means, responsive to the throttle position sensor means, for varying the pulse width when the throttle position is at a position corresponding to mid range engine RPM operating conditions; and third adjustment means, input to the pulse width signal generating means, for adjusting the pulse width under high RPM engine operating conditions.

4. The fuel injection system defined in claim 3 wherein said fuel injection means comprises a plate like adapter member adapted to be fixedly and sealingly mounted on said manifold in overlying relationship with said fuel-air mixture inlet and having means for fixedly and sealingly mounting said throttle body on said plate like adapter member in overlying relationship to said adapter member, said adapter member having first passage means therethrough for establishing direct fluid communication between the combustion air passages means in said throttle body and said fuel-air mixture inlet of said manifold, and second passage means through said adapter member for circulating engine coolant through said member.

5. The fuel injection system defined in claim 4 wherein the adpater member is disposed in the engine compartment of a vehicle and the control means is mounted in the vehicle separate and isolated from the engine compartment.

6. A fuel injection system for an internal combustion enging having a fuel supply tank and an intake manifold having a fuel-air mixture inlet;

said system comprising a throttle body having a combustion air passages means extending therethrough from a combustion air inlet to an outlet, adjustable positionable throttle means in said combustion air passage means for controlling the flow of a fuel-air mixture therethrough, adaptor means for mounting said throttle body on said manifold with the outlet of said combustion air passage means opening into said fuel-air mixture inlet of said manifold, said adapter means comprising a plate like member adapted to be fixedly and sealingly mounted on said manifold in overlying relationship with said fuel-air mixture inlet and having means for fixedly and sealingly mounting said throttle body on said plate like member in overlying relationship to said member, said member having first passage , means therethrough for establishing direct fluid communication between said combustion air passage means in said throttle body said fuel-air mixture inlet of said manifold, and second passage means through said member for circulating engine coolant through said member, cyclically operable fuel injection means on said body for cyclically injecting pulses of fuel into said combustion air passage means, fuel pump means for pumping fuel to said injection means from said fuel supply tank, control means including throttle position sensing means and engine speed sensing means for cyclically actuating said injection means to inject fuel into said passage in pulses of time durations and cyclic frequencies variable in response to variations in throttle position and engine speed respectively sensed by said throttle position and said engine speed sensing means, and adjustment means on said control means for establishing independently selected fuel to air mixture ratios during idle, mid range, and high speed operations of said engine.

7. The fuel injection system defined in claim 6 wherein said combustion air passage means comprises a pair of combustion air passages extending vertically therethrough, said injector means including a pair of fuel injectors each having a fuel inlet and a fuel discharge nozzle assembly with the nozzles of the injectors fixedly mounted upon said body in aligned overlying relationship to the respective combustion air passages, pressure regulator means fixedly mounted on said body and having a fuel chamber therein in constant fluid communication with said fuel pump means and with said injector fuel inlets, and means for maintaining the pressure of fuel within said chamber at a selected constant pressure.

8. The fuel injection system defined in claim 7 wherein said control means includes means for regulating said fuel pump means to cause said pump means to pump fuel to said fuel chamber at a rate greater than the rate at which fuel is injected into said combustion air passages by said injector means, and presssure responsive valve means in said pressure regulating means for discharging excess fuel from said chamber to said fuel tank to maintain said selected constant pressure within said chamber.

9. The fuel injection system defined claim 7 wherein said injector assemblies each include a solenoid actuated valve controlling fluid communication between said fuel inlet and said fuel discharge nozzle, and said control means comprises means for supplying a first pulse width modulated signal to cyclically energize and deenergize the valve solenoid to discharge fuel from said nozzle in pulses of a frequency and time duration controlled by said throttle position sensing means and said engine speed sensing means and for supplying a second electrical signal operable to cause said fuel pump means to maintain said selected constant pressure at the fuel inlet of the injector.

10. A stand-alone throttle body fuel injection system including fuel injector means for injecting fuel from a throttle body into the fuel-air inlet of an engine manifold, comprising:

an electronic control means for controlling the activation of the fuel injector, the electronic control means comprising:

means for generating a pulse width modulated signal having a predetermined frequency and pulse width to the fuel injectors;

frequency signal generating means, responsive to the engine RPM, for generating a signal to the pulse width modulated signal generating means having a frequency proportional to the engine RPM;

pulse width signal generating means, responsive to the engine throttle position, for generating a signal to the pulse width modulated signal generating means having a pulse width proportional to the engine throttle position;

throttle position sensor means for sensing the throttle position and generating an output proportional thereto;

means, responsive to the engine RPM, for generating an engine RPM signal, and manually operable adjustment means on said control means and input to the pulse width modulated signal generating means for establishing independently selected fuel to air mixture ratios during idle, mid range and high engine RPM operations, the adjustment means being at least responsive to the throttle position sensor means when the throttle position is at a position corresponding to mid range engine RPM operating conditions.

11. The system of claim 10 further including:

first idle adjustment means, input to the pulse width signal generating means, for establishing a base idle pulse width.

12. The system of claim 10 wherein the frequency signal generating means comprises:

a voltage controlled oscillator.

13. The fuel injection system defined in claim 10 wherein said fuel injection means comprises a plate like adapter member adapted to be fixedly and sealingly mounted on said manifold in overlying relationship with said fuel-air mixture inlet and having means for fixedly and sealingly mounting said throttle body on said plate like adapter member in overlying relationship to said adapter member, said adapter member having first passage means therethrough for establishing direct fluid communication between the combustion air passage means in said throttle body and said fuel-air mixture inlet of said manifold, and second passage means through said adapter member for circulating engine coolant through said member.

14. The system of claim 10 further including:

throttle position sensor means for sensing the throttle position and generating an output proportional thereto; and means, responsive to the engine RPM, for generating an engine RPM signal.

15. The system of claim 14 further including:

second mid-range adjustment means, responsive to the throttle position sensor means, for varying the pulse width when the throttle position is at a position corresponding to mide range engine operating conditions.

16. The system of claim 14 further including:

third adjustment means, input to the pulse width signal generating means, for adjusting the pulse width under high engine operating conditions.

17. The system of claim 14 further including:

means, responsive to the ignition switch of the engine, the throttle position sensor means, and the engine RPM, for varying the speed of the fuel pump of the engine in proportion to the engine RPM.

18. The system of claim 14 further including:

fast idle solenoid driver means for driving a fast idle solenoid;

engine coolant temperature sensor means for sensing the coolant temperature of the engine; and temperature adjustment means for adjusting the pulse

* * * * *